US009694954B2

(12) United States Patent
Lank

(10) Patent No.: US 9,694,954 B2
(45) Date of Patent: Jul. 4, 2017

(54) TANK FILLING SYSTEM

(71) Applicant: Andreas Stihl AG & Co. KG, Waiblingen (DE)

(72) Inventor: Jonas Lank, Winnenden (DE)

(73) Assignee: Andreas Stihl AG & Co. AG, Waiblingen (DE)

( * ) Notice: Subject to any disclaimer, the term of this patent is extended or adjusted under 35 U.S.C. 154(b) by 0 days.

(21) Appl. No.: 14/744,905

(22) Filed: Jun. 19, 2015

(65) Prior Publication Data

US 2015/0368007 A1 Dec. 24, 2015

(30) Foreign Application Priority Data

Jun. 20, 2014 (DE) ..... 10 2014 009 357

(51) Int. Cl.

| | |
|---|---|
| ***B65D 47/32*** | (2006.01) |
| ***B67D 7/00*** | (2010.01) |
| ***B65D 47/12*** | (2006.01) |
| ***B65D 47/20*** | (2006.01) |

(52) U.S. Cl.

CPC ..... *B65D 47/32* (2013.01); *B65D 47/122* (2013.01); *B65D 47/20* (2013.01); *B67D 7/005* (2013.01)

(58) Field of Classification Search

CPC ..... B65D 47/122; B65D 47/20; B65D 47/32; B67D 7/005

See application file for complete search history.

(56) References Cited

U.S. PATENT DOCUMENTS

| | | | | |
|---|---|---|---|---|
| 5,406,994 | A | 4/1995 | Mitchell et al. | |
| 6,629,624 | B2 * | 10/2003 | Stillinger | B65D 47/2025 220/254.7 |
| 7,651,003 | B2 * | 1/2010 | Albers | B65D 47/263 215/251 |
| 2004/0262337 | A1 * | 12/2004 | Young | B65D 47/0838 222/484 |
| 2011/0049195 | A1 * | 3/2011 | Russell | B65D 47/244 222/513 |
| 2012/0187157 | A1 * | 7/2012 | Yuan | B65D 47/2068 222/496 |
| 2015/0368007 | A1 * | 12/2015 | Lank | B65D 47/122 222/545 |

FOREIGN PATENT DOCUMENTS

| | | |
|---|---|---|
| CA | 2703183 A1 | 10/2011 |
| DE | 20 2005 017 237 U1 | 1/2006 |
| DE | 10 2012 020 751 B3 | 5/2013 |

* cited by examiner

*Primary Examiner* — Frederick C Nicolas
*Assistant Examiner* — Bob Zadeh
(74) *Attorney, Agent, or Firm* — Walter Ottesen, P.A.

(57) ABSTRACT

The invention relates to a tank filling system having a protective cap and having a pouring spout. The protective cap has an end position wherein it partially covers the pouring spout, and wherein the protective cap has an opened position wherein it is removable from the pouring spout into a removed position. The pouring spout includes at least one valve, wherein the valve has a venting position and a closed valve position. In the venting position, the valve frees at least one passage for a fluid. In the closed valve position, the valve closes the passage. In the end position of the protective cap, the valve is in the closed valve position. During the adjustment of the protective cap from the end position into the opened position, the valve is forcibly adjusted at least temporarily into the venting position.

14 Claims, 8 Drawing Sheets

FIG. 1
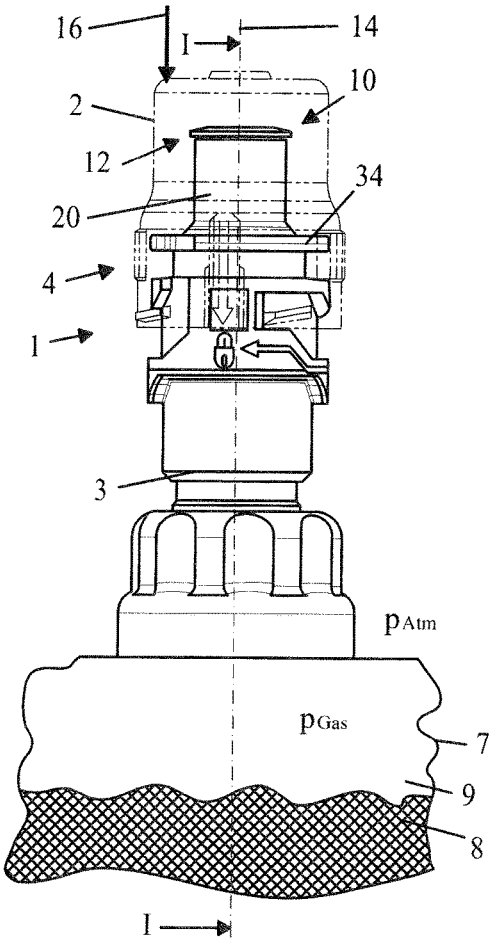
FIG. 2
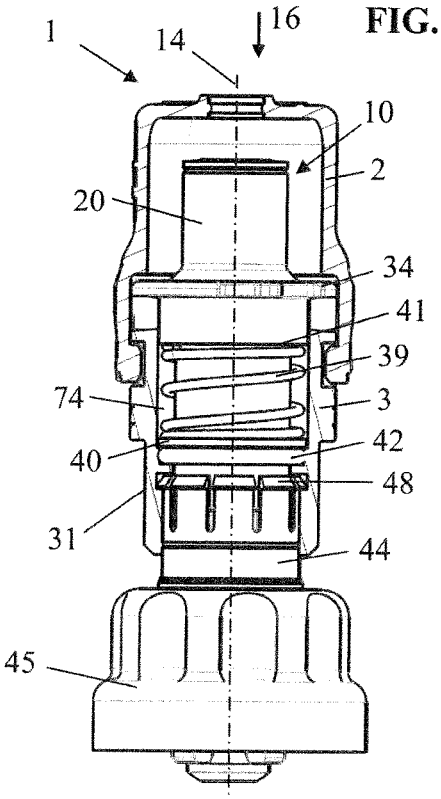
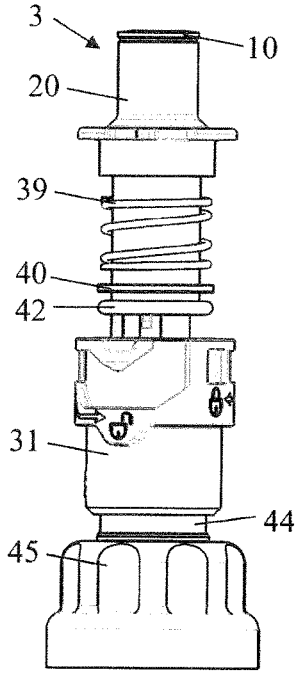
FIG. 3

FIG. 10
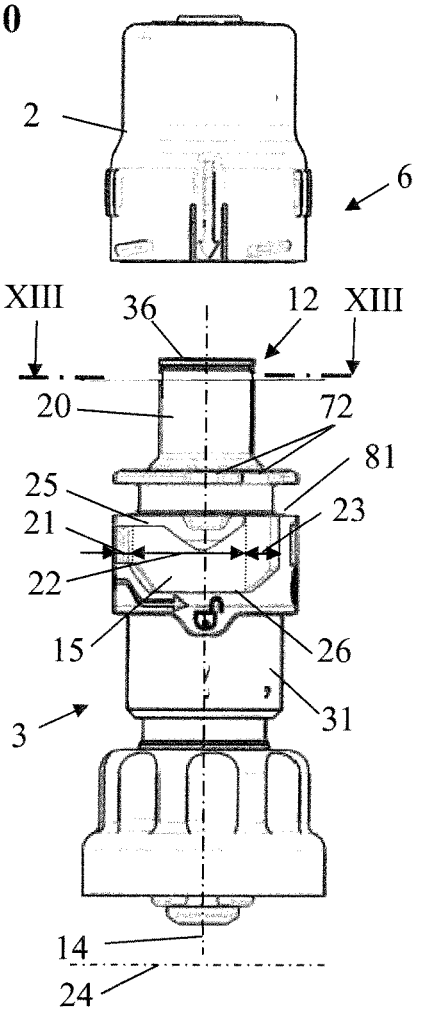
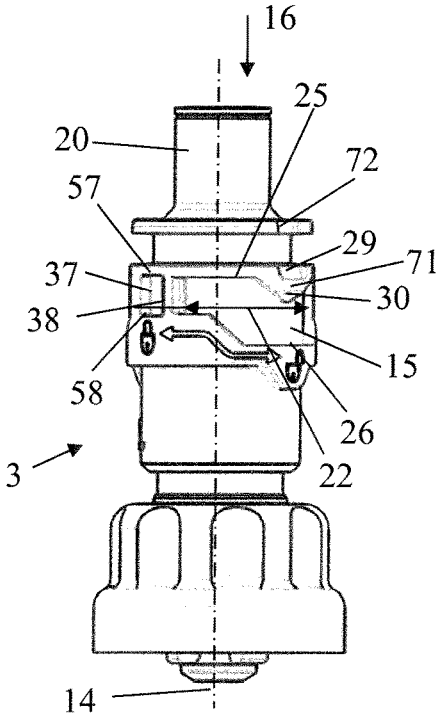
FIG. 11
FIG. 12
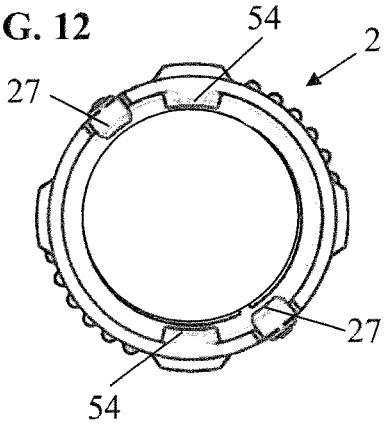
FIG. 13
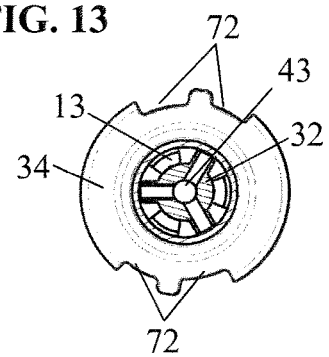

TANK FILLING SYSTEM

CROSS REFERENCE TO RELATED APPLICATION

This application claims priority of German patent application no. 10 2014 009 357.3, filed Jun. 20, 2014, the entire content of which is incorporated herein by reference.

BACKGROUND OF THE INVENTION

DE 20 2005 017 237 U1 discloses a tank filling system, the protective cap of which is screwable onto a pouring spout. The protective cap has a venting position in which the protective cap is not completely sealed off with respect to the pouring spout and so the container can be vented and a differential pressure between the container interior and the atmosphere can be equalized.

U.S. Pat. No. 5,406,994 discloses a canister having a pouring spout which has a valve. In the unactuated state of the pouring spout, the valve is closed. The valve is opened when the pouring spout is pushed onto the filler neck of a container to be filled. In this case, a venting valve of the pouring spout is also opened.

SUMMARY OF THE INVENTION

It is an object of the invention to provide a tank filling system, which effects reliable and safe venting in a simple manner when the protective cap is opened.

The object is achieved by a tank filling system having: a pouring spout; a protective cap defining an end position and an opened position; the protective cap being configured to be removable to a removed position when in the opened position and to at least partially cover the pouring spout in the end position; the pouring spout having a valve; the valve having a venting position and a closed position; a through passage; the valve being configured to clear the through passage for passing a fluid in the venting position thereof and to close the through passage in the closed position; the valve being further configured to be in the closed position thereof when the protective cap is in the end position; and, the valve being configured to compulsorily assume, at least temporarily, the venting position thereof when the protective cap is shifted from the end position to the opened position thereof.

Provision is made for the valve to be forcibly in the venting position at least temporarily when the protective cap is adjusted from the end position into the opened position. As a result, during the adjustment from the end position into the opened position, venting always takes place via the passage freed by the valve. As a result of the functional separation of the valve for venting and the protective cap as a means for protecting the pouring spout from damage and in particular as an actuation means which forcibly actuates the protective cap during the adjustment from the end position into the opened position, reliable and safe venting takes place even in the case of a comparatively high differential pressure. Automatic venting takes place during the adjustment of the protective cap from the end position into the opened position.

In the end position, the protective cap at least partially covers the pouring spout and so the protective cap at least partially protects the pouring spout from damage, for example by a mechanical action. Advantageously, in the end position, the protective cap completely covers the valve. As a result, the valve is protected from damage and contamination in the end position of the protective cap.

Advantageously, the valve includes a closure part. Advantageously, at least one actuating element is arranged on the protective cap. Advantageously, during the adjustment of the protective cap from the end position into the opened position, the actuating element forcibly actuates the closure part at least temporarily and changes the valve position. As a result, forced venting of the liquid container can be achieved in a simple manner while the protective cap is being opened. A positive guide expediently acts between the protective cap and the pouring spout in order to forcibly actuate the closure part, wherein the positive guide includes a guide section and a displacement link or slider. The protective cap can be adjusted safely into the venting position in a structurally simple manner via a slider. Preferably, the protective cap rotates during the adjustment from the end position into the opened position. A travel movement of the protective cap is given by the slider, depending on the rotary movement of the protective cap. On account of the travel movement, the actuating element forcibly actuates the closure part and venting takes place.

Expediently, the closure part is mounted in a sprung manner, wherein the spring force pushes the valve into the closed valve position. This ensures that when the valve is unactuated, the passage is not freed and no fluid, specifically no gases and/or no liquids, can escape.

Advantageously, the protective cap rotates about a rotation axis during the adjustment from the end position into the opened position, wherein the slider moves the protective cap in the direction of the rotation axis during a rotation of the protective cap about the rotation axis, and in particular executes a venting travel. Advantageously, the actuating element actuates the closure part at least temporarily in the direction of the rotation axis, in particular counter to the spring force. As a result, an operator merely has to turn the protective cap during the adjustment of the protective cap from the end position into the opened position. The travel movement of the protective cap is forcibly brought about on account of the slider, and so forced actuation of the valve and thus forced venting takes place.

Preferably, the valve is in a closed valve position when the protective cap is in the opened position and when the protective cap is in the end position. As a result, fluid cannot escape either in the opened position or in the end position of the protective cap. Expediently, at least one latching device is arranged on the pouring spout, wherein the protective cap latches with the latching device in the end position. As a result, the protective cap is seated in a comparatively tight manner on the pouring spout in the end position, and so accidental adjustment of the protective cap, in particular accidental venting and thus freeing of the passage, is prevented. This additionally ensures that the protective cap, which at least partially covers the pouring spout in the end position, is seated tightly on the pouring spout and protects the latter safely and reliably from damage.

Advantageously, the protective cap is formed at least partially in an elastic manner, and the protective cap is able to be moved from the removed position into the end position by at least partial elastic deformation without forced venting. As a result, the protective cap can be plugged comparatively quickly onto the pouring spout. Since the protective cap is usually plugged onto the pouring spout after a tank filling operation, and venting usually takes place during the tank filling operation, venting is not necessary while the protective cap is being placed onto the pouring spout.

Therefore, it is sufficient to bring the protective cap into the end position without forced venting.

Preferably, the guide profile is arranged on an elastic arm fixed to the protective cap. Preferably, the arm deforms elastically at least once when the protective cap is brought from the removed position into the end position. Since the arm formed on the protective cap is elastic, the protective cap can be formed in a nonelastic manner away from the elastic arm, and so good mechanical protection for the pouring spout is ensured in the end position. Expediently, a first stop is arranged on the pouring spout, wherein the first stop prevents the protective cap being removed from the end position into the removed position without a rotary movement. As a result, the protective cap cannot be removed from the end position without forced venting.

Advantageously, the pouring spout has a fastening device for fastening the pouring spout to a liquid container, and the protective cap has means for fastening to the fastening device. If the pouring spout is not fastened to the liquid container, the protective cap can be fixed to the fastening device. As a result, fuel residues can be prevented from escaping from the pouring spout and the tank filling system is protected from contamination. Advantageously, the fastening device includes at least one thread, in particular an internal thread, and at least one threaded element is advantageously provided on the protective cap. Advantageously, the protective cap is able to be screwed onto the thread of the fastening device by way of the threaded element. Instead of a thread and a threaded element, it is also possible to provide a latching connection, a plug device, a bayonet connection or the like, however. Preferably, a second stop is arranged on the pouring spout. The second stop prevents venting in the end position. This prevents accidental venting, or freeing of the passage, in the end position, for example by pressing on the protective cap.

Advantageously, at least one scraping lip is arranged on the protective cap. The scraping lip serves in particular for scraping contaminants from the pouring spout. The scraping lip is advantageously arranged such that it scrapes contaminants from the pouring spout during the adjustment of the protective cap from the removed position into the end position. Preferably, a first scraping lip is arranged within the protective cap, so that automatic scraping of contaminants takes place during the adjustment of the protective cap. Alternatively or in addition, a second scraping lip can be fastened to the outside of the protective cap. An operator can thus scrape the contaminants from the pouring spout with the protective cap removed.

BRIEF DESCRIPTION OF THE DRAWINGS

The invention will now be described with reference to the drawings wherein:

FIG. 1 is a schematic of a pouring spout with placed-on protective cap, illustrated by way of dashed lines, in an end position;

FIG. 2 is a schematic of the tank filling system from FIG. 1 in partial section;

FIG. 3 shows an exploded illustration of the pouring spout with valve, closure part and spring;

FIG. 10 is a side view of the tank filling system with the protective cap in the removed position;

FIG. 11 is a side view of the pouring spout with the slider;

FIG. 12 is a view of the protective cap from below;

FIG. 13 is a section along the line XIII-XIII in FIG. 10;

DESCRIPTION OF THE PREFERRED EMBODIMENTS OF THE INVENTION

Figure 4:
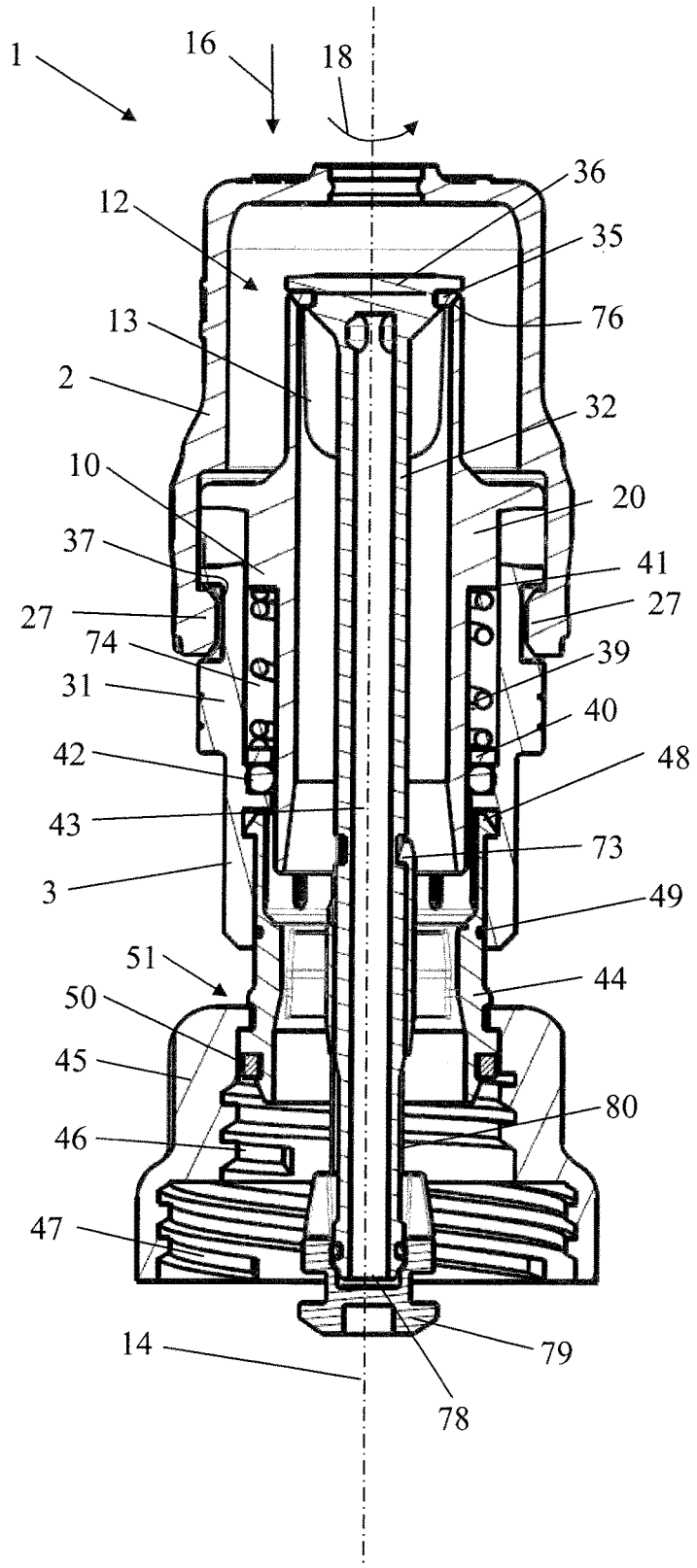
FIG. 4 shows a longitudinal section through the tank filling system along the line I-I in FIG. 1.

FIG. 1 schematically shows an embodiment of a tank filling system 1. The tank filling system 1 can also be referred to as a tank filling device. In the embodiment, the tank filling system 1 is screwed onto a liquid container 7, for example a canister, and connected to the liquid container 7 in a liquid-tight manner. At least one fluid is present in the liquid container 7. In the embodiment, a liquid 8, for example fuel, a fuel/oil mixture, oil or the like, is present in the liquid container 7. Present above the liquid level is a gas 9. The gas 9 can be air or a mixture of air and partially evaporated liquid 8.

The tank filling system 1 has a pouring spout 3, through which the fluid can be poured out of the liquid container 7 and into a tank. A protective cap 2, shown in a dot-dashed and phantom outline in FIG. 1, has been placed onto the pouring spout 3. The protective cap 2 closes off the pouring spout in the end position 4, shown in FIG. 1, of the protective cap 2. In order to avoid spillage of liquid during a filling operation before the pouring spout 3 has been fully placed on a tank neck of the tank to be filled, the pouring spout 3 has a valve 10, which is in a closed valve position 12, shown in FIG. 1, in the unactuated state. The valve 10 has a closure part 20 having an outwardly projecting collar 34. If the closure part 20 is pushed in one direction of movement 16, the valve 10 is opened and fluid 8 can be poured out of the liquid container 7.

FIGS. 2 to 4 show the structure of the pouring spout 3 with the valve 10 in detail. The pouring spout 3 includes a housing portion 31 on which the protective cap 2 is held. In the embodiment, the protective cap 2 has two mutually opposite, inwardly projecting guide portions 27 which project into latching recesses 37 in the housing portion 31. The closure part 20 is mounted in the housing portion 31 so as to be displaceable in the direction of the longitudinal center axis of the pouring spout 3. The longitudinal center axis corresponds to a rotation axis 14 about which the protective cap 2 is rotatable relative to the housing part 31. The direction of movement 16 extends parallel to the rotation axis 14 and points in the direction toward the liquid container 7. As FIGS. 2 and 3 show, the closure part 20 is supported on the housing portion 31 via a spring 39 which pretensions the closure part 20 in the direction of the closed valve position 12. The spring 39 lies with one end against an annular disk 40, which is supported on the housing portion 31 via a sealing ring 42, and with the other end against a shoulder 41 formed on the closure part 20. The spring 39 pretensions the closure part 20 counter to the direction of movement 16, that is, in the direction of the closed valve position 12. The spring 39 is arranged in an annular space 74 between the closure part 20 and the housing portion 31. The sealing ring 42 seals off the housing portion 31 with respect to the closure part 20 and is in the form of an O-ring in the embodiment.

The pouring spout 3 includes a fastening device 45, which is held on the housing portion 31 via a carrier 44. As FIG. 4 shows, the fastening device 45 has a first internal thread 46 and a second internal thread 47, which is described in more detail in the following text. The first internal thread 46 is provided to screw the fastening device 45 onto a thread formed on the liquid container 7 and thus to fix it to a container opening of the liquid container 7. The fastening device 45 is mounted on the carrier 44 so as to be rotatable about the rotation axis 14. As a result, the fastening device 45 can be screwed onto the liquid container 7 without the housing portion 31 co-rotating. For this purpose, the carrier 44 is latched with the fastening device 45 via a latching connection 51. Arranged between the carrier 44 and the fastening device 45 is a sealing ring 50, which provides sealing between the fastening device 45 and the carrier 44. When the fastening device 45 is screwed on the liquid container 7, the sealing ring 50 provides direct sealing between the pouring spout 3 and the liquid container 7.

As FIG. 2 and FIG. 4 show, the carrier 44 is latched with the housing portion 31 via latching projections 48. Arranged between the housing portion 31 and the carrier 44 is an annular seal 49 (shown in FIG. 4), which seals off the carrier 44 with respect to the housing portion 31. The carrier 44 can be rotatable about the rotation axis 14 relative to the housing portion 31. The pouring spout 3 includes a valve body 32 (shown in FIG. 4), which is connected to the carrier 44 via a latching connection 73 and is held on the carrier 44 so as not to be displaceable in the direction of the rotation axis 14. The valve body 32 is firmly connected axially to the housing portion 31 via the carrier 44, and the closure part 20 is mounted so as to be movable in the direction of the rotation axis 14 relative to the housing portion 31 and relative to the valve body 32.

Figure 6:
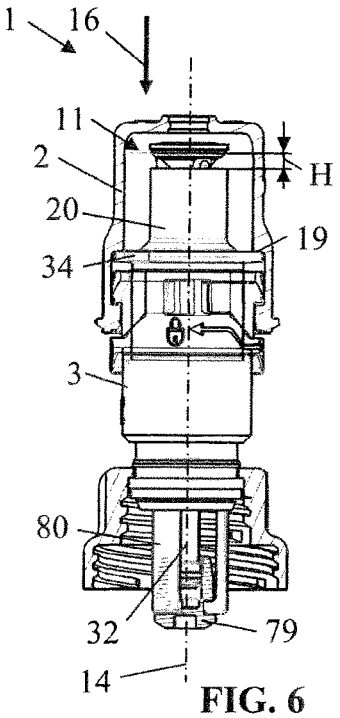
FIG. 6 is a schematic of the tank filling system in partial section, with the valve in the venting position.

Formed in the valve body 32 is a vent duct 43, which extends in the direction of the rotation axis 14 and centrally through the valve body 32 in the embodiment. Formed in the annular space between the valve body 32 and the closure part 20 is at least one passage 13. The valve body 32 includes a circular valve disk 36 on which an annular seal 35 is held. Formed on the closure part 20 is a sealing seat 76 against which the annular seal 35 bears in the closed valve position 12 shown in FIG. 3 and closes the passage 13 and the vent duct 43. The valve disk 36 and the sealing seat 76 are oriented in a rotationally symmetrical manner with respect to the rotation axis 14. The valve body 32 is formed in an approximately tubular manner and has, at its end remote from the valve disk 36, an opening 78 by way of which the vent duct 43 leads into the liquid container 7. Arranged at the opening 78 is a plug 79, which closes the opening 78 in the closed valve position 12 shown in FIG. 4. The plug 79 is held on the closure part 20 via arms 80, which are also shown in FIG. 6. If the closure part 20 is moved in the direction of movement 16, the plug 79 is lifted from the valve body 32 and frees the opening 78.

The gas 9 in the liquid container 7 has a gas pressure $p_{GAS}$ (shown in FIG. 1) which may be less than, equal to or greater than the atmospheric pressure $p_{Atm}$ of the surroundings. In order to be able to equalize a differential pressure between the gas pressure $p_{Gas}$ and the atmospheric pressure $p_{Atm}$, provision is made to use the valve 10 for forced venting of the liquid container 7.

Figure 5:
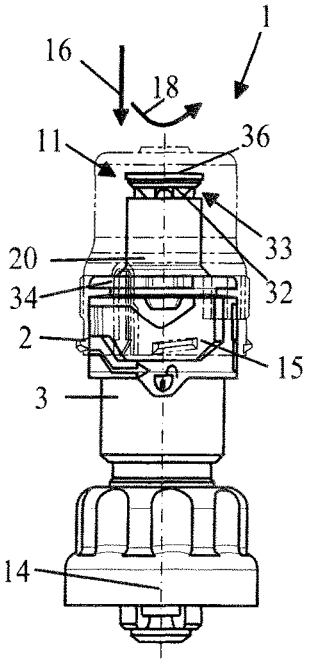
FIG. 5 shows a side view of the tank filling system with the valve in the venting position.
Figure 7:
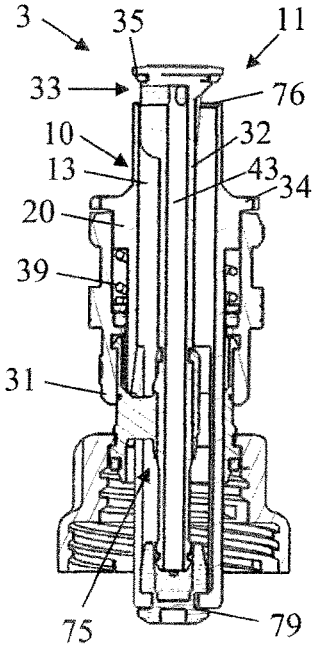
FIG. 7 is a longitudinal section through the pouring spout with the valve in the venting position.

In the end position 4 (shown in FIGS. 1 to 4) of the protective cap 2, the protective cap 2 is latched with the pouring spout 3 and at least partially covers the pouring spout 3. In order to remove the protective cap 2 from the pouring spout 3, the protective cap 2 should first of all be shifted, from the end position 4 shown in FIGS. 1 to 4, in a direction of rotation 18 via the intermediate position shown in FIGS. 5 to 7 and into the opened position 5 shown in FIGS. 8 and 9. In this case, the protective cap 2 should be rotated about the rotation axis 14. Subsequently, the protective cap 2 can be removed from the pouring spout 3, counter to the direction of movement 16, into a removed position 6 shown in FIG. 10. In the removed position 6, the protective cap 2 has been completely removed from the pouring spout 3.

When the protective cap 2 is shifted from the end position 4 into the opened position 5, the protective cap 2 forcibly actuates the valve 10 such that the valve 10 is forcibly at least temporarily in the venting position 11. To this end, a positive guide is provided with a slider 15 (shown in FIG. 5), which is arranged on the pouring spout 3, and the guide portions 27, which are arranged on the protective cap 2. The positive guide converts the rotary movement of the protective cap 2 into a combined rotary and travel movement of the protective cap 2. It is not possible to take off the protective cap 2 without a rotary movement. The travel movement takes place parallel to the direction of movement 16. In the venting position 11 (shown in FIGS. 5 to 7) of the valve 10, the closure part 20 has been displaced, with respect to the closed valve position 12 shown in FIGS. 1 to 4, in the direction of movement 16 relative to the valve body 32. As a result, the annular seal 35 is lifted from the sealing seat 76 and a gap 33 is formed between the valve body 32 and the closure part 20, with a gap width which corresponds to a travel H of the closure part 20. The travel H can be advantageously about 3 mm to about 10 mm. Via the gap 33, the passage 13 is freed. The opening 78 is closed by the plug 79 and would only be opened upon continued travel of the closure part 20. The protective cap 2 has a circumferential actuating element 19, which is in the form of a shoulder and which presses against the collar 34 in the venting position 11 and keeps the closure part 20 in the venting position 11 counter to the force of the spring 39 (FIG. 4). The passage 13 has an inlet 75, formed on the closure element 20, at which fluids can pass into (or out of) the passage 13 and can pass out of (or into) the passage 13 through the gap 33.

Figure 8:
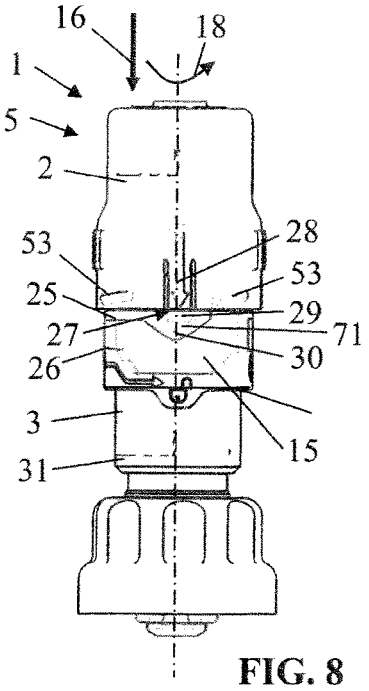
FIG. 8 shows a side view of the tank filling system with the protective cap in the opened position.
Figure 9:
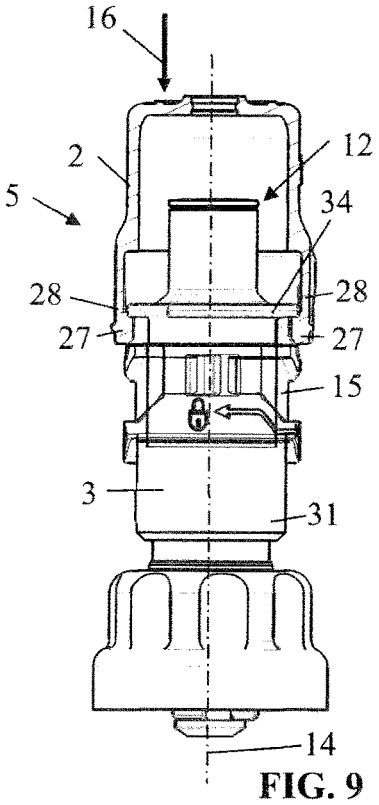
FIG. 9 is a schematic of the tank filling system in partial section, with the protective cap in the opened position.

Upon continued rotation of the protective cap 2 in the direction of rotation 18, the protective cap 2 moves counter to the direction of movement 16 on account of the positive guide until the protective cap 2 latches, in the opened position 5 shown in FIGS. 8 and 9, with the guide portions 27 behind the collar 34. The guide portions 27 are no longer guided in the slider 15 in the opened position 5. From the opened position 5 shown in FIGS. 8 and 9, the protective cap 2 can be pulled off counter to the direction of movement 16 without being rotated. In this case, the latching of the guide portions 27 behind the collar 34 is released and the protective cap 2 is moved into the removed position 6 shown in FIG. 10.

FIGS. 10 and 11 show the configuration of the slider 15. The slider 15 has an upper channel wall 25, located closer to the valve disk 36, and a lower channel wall 26 located further away from the valve disk 36. In the circumferential direction, the slider 15 includes a first portion 21, a second portion 22 and a third portion 23. The first portion 21 extends parallel to an imaginary plane 24 which is perpendicular to the rotation axis 14. In the first portion 21, the channel walls 25 and 26 extend parallel to the imaginary plane 24. In the second portion 22, which follows the first portion 21 in the direction of rotation 18, the slider 15 extends in an inclined manner with respect to the imaginary plane 24. In a first region, the slider 15 diverges from the valve head 36, and in a second, following region, the slider 15 is inclined in the opposite direction and extends toward the valve head 36. The magnitude of the angle is preferably in a range between 20° and 60°. In the second portion 22, the upper channel wall 25 has a V-shaped profile. In the second portion 22, the lower channel wall 26 extends parallel to the imaginary plane 24 in the region in which the upper channel wall 25 extends in a V shaped manner. In the third portion 23, the upper channel wall 25 extends parallel to the rotation axis 14 as far as the end side, located facing the collar 34, of the housing portion 31. The lower channel wall 26 extends first of all in an inclined manner with respect to the rotation axis 14 and parallel to the upper channel wall 25 and then extends parallel to the rotation axis 14 as far as the end side of the housing portion 31.

As FIG. 11 shows, the latching recess 37 is arranged in a manner adjoining the first portion 21 of the slider 15. The latching recess 37 is located in one plane with the first portion 21. Provided between the latching recess 37 and the slider 15 is an outwardly projecting wall segment 38, behind which the guide portion 27 latches in the end position 4. When the protective cap 2 is rotated out of the end position 4 in the direction of rotation 18, the guide portion 27 is moved out of the latching recess 37 via the wall segment 38 and into the first portion 21. Each latching recess 37 has a first stop 57, which is arranged, counter to the direction of movement 16, adjacent to the guide portions 27 and prevents the protective cap 2 from being removed without the protective cap 2 being rotated about the rotation axis 14. Each depression 21 also has a second stop 58, which prevents the protective cap 2 from being moved in the direction of movement 16 in the end position 4.

As FIG. 12 shows, the protective cap 2 has a guide element 54 adjacent to each guide portion 27 in the circumferential direction. Both the guide portions 27 and the guide elements 54 are guided in the slider 15. The guide portions 27 are in this case held in an elastically resilient manner on the arms 28 (FIG. 9). In the end position 4, the guide elements 54 are each located in the first portion 21 of the slider 15. As FIG. 13 shows, cutouts 72 for the guide element 54 and the guide portion 27 are provided in the collar 34 of the closure element 20. As a result, the protective cap 2 can be placed onto the pouring spout 3 without the closure element 20 being pushed down in the direction of movement 16. In this case, in each case one cutout is arranged adjacent to the second portion 22 and one cutout 72 is arranged adjacent to the third portion 23 of the slider 15. In the second portion 22, a ramp 30, shown in FIG. 11, is provided on the upper channel wall 25. When the protective cap 2 is adjusted out of the venting position 11 (FIGS. 5 to 7) into the opened position 5 (FIGS. 8 and 9), the guide portion 27 slides over the ramp 30. In the process, the arm 28 is elastically deformed. The guide element 54 is simultaneously moved through the third portion 23. FIG. 13 also shows the arrangement of the venting duct 43 and of the passage 13.

When the protective cap 2 is closed, the guide portion 27 is pushed into the slider 15, wherein the arm 28 is elastically deformed. In order that the arm 28 can be elastically deformed more easily, a slope 29 is provided on the housing portion 31 above the slider 15. In the direction of movement 16, the distance of the surface of the slope 29 from the rotation axis 14 increases. The slope 29 is adjoined by a wall portion 71 which extends parallel to the rotation axis 14. The wall portion 71 is adjoined by the ramp 30.

Figure 14:
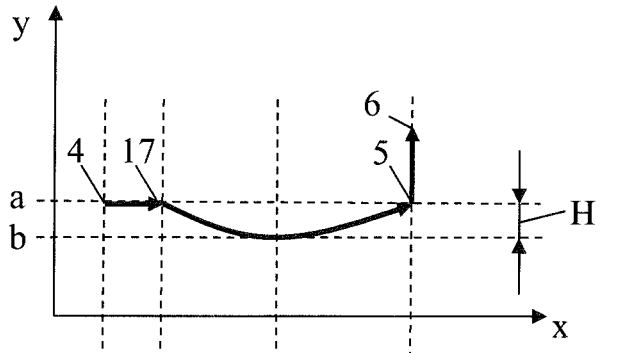
FIGS. 14 and 15 are schematics illustrating the adjusting movement of the protective cap and the travel movement of the closure part of the valve.
Figure 15:
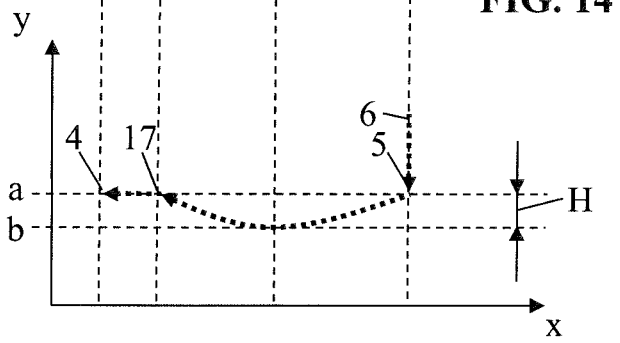

FIGS. 14 and 15 schematically show the travel position of the closure part 20 with respect to the rotary position of the protective cap 2.

The rotary position of the protective cap 2 is plotted on the x-axis of the diagram and the travel movement of the closure part 20 and of the protective cap 2 is plotted on the y-axis. FIG. 14 shows the movement during the opening of the protective cap 2. In the end position 4, the protective cap 2 is latched with the pouring spout 3. By way of a first rotary movement from the end position 4 into an unlatched position 17, the latching between the protective cap 2 and the pouring spout 3 is released. In this case, no travel movement takes place. The protective cap 2 and the closure part 20 are in a first travel position (a), in which the valve 10 is closed. If the protective cap 2 is rotated further in the direction of rotation 18, the protective cap 2 and the closure part 20 execute a travel movement via a second travel position (b), which is associated with the venting position 11, back into the first travel position (a). The difference between the first travel position (a) and the second travel position (b) corresponds to the travel H. In the opened position 5, the closure part 20 is located in the first travel position (a). On account of the travel movement, the valve 10 is forcibly vented during the rotary movement from the end position 4 to the opened position 5.

During the closing, schematically shown in FIG. 15, of the pouring spout 3 with the protective cap 2, that is during the adjustment of the protective cap from the removed position 6 via the opened position 5 into the end position 4, the protective cap 2 and the closure part 20 likewise execute a travel movement from the first travel position (a) via the second travel position (b) back into the first travel position (a). As a result, forced venting also takes place during the closing of the liquid container 7 with the protective cap 2.

Figure 16:
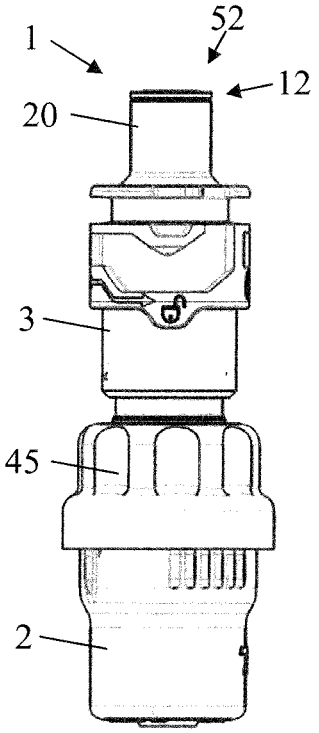
FIG. 16 is a side view of the tank filling system in a transport state.

FIG. 16 shows the tank filling system 1 in a transport state 52. In the transport state 52, the protective cap 2 has been screwed together with the fastening device 45. To this end, screw elements 53, shown in FIG. 8, are provided on the outer side of the protective cap 2. The protective cap 2 is able to be screwed into the second internal thread 47, shown in FIG. 4, by way of the screw elements 53. In the transport state 52, the protective cap 2 thus protects the pouring spout 3 from the penetration of dirt or from the escape of liquid from the pouring spout 3. Rather than a threaded connection, some other connection can also be provided between the protective cap 2 and the fastening device 45, for example a bayonet connection or the like.

Figure 17:
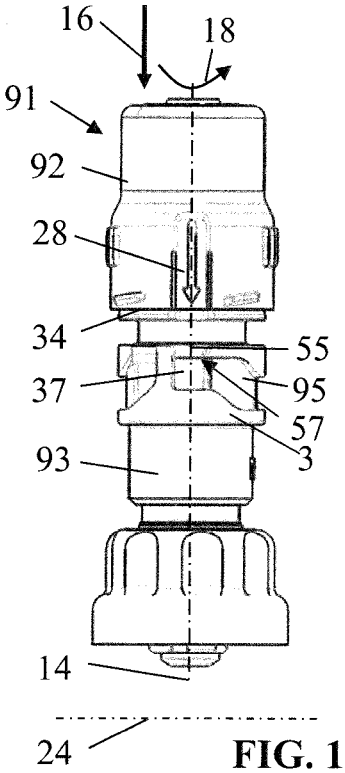
FIG. 17 is a side view of a variant embodiment of the tank filling system.
Figure 18:
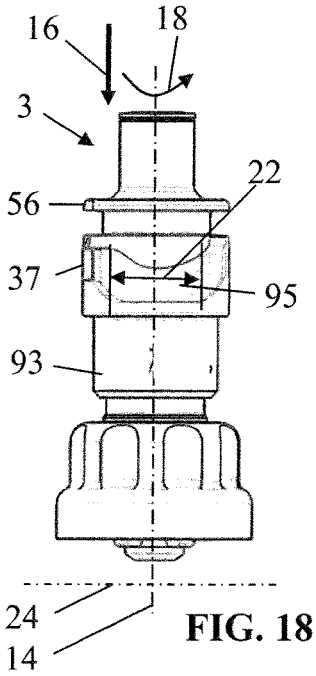
FIG. 18 is a side view of the pouring spout of the tank filling system from FIG. 17.
Figure 19:
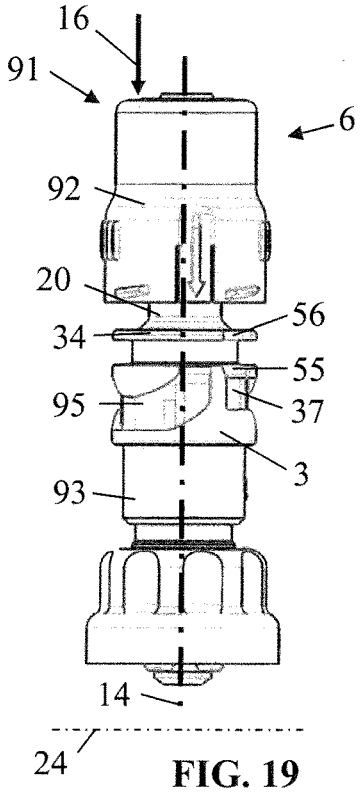
FIG. 19 shows a side view of the tank filling system with the protective cap in the removed position.

FIGS. 17 to 19 show an embodiment of a tank filling system 91 which includes a protective cap 92. The protective cap 92 has guide portions 27 which guide the protective cap 92 in a slider 95. Guide elements 54 are not provided, however. Identical reference signs in FIGS. 17 to 19 denote identical elements to those in FIGS. 1 to 16. The housing portion 93 of the tank filling system 91 has a slope 55 on that side of the latching recess 37 that is adjacent to the collar 34. Adjacent thereto, provision is made of a cutout 56 in the collar 34. When the protective cap 92 is placed onto the pouring spout 3, the protective cap 92 is oriented such that the guide portion 27 is guided through the cutout 56 in the direction of movement 16 and subsequently slides over the slope 55 in order finally to be located in the end position 4 in the latching recess 37. In this position, the protective cap 92 is latched with the pouring spout 3. The slope 55 is configured such that the protective cap 92 can be pushed from the removed position 6 in the direction of movement 16 into the end position 4. In order to adjust the protective cap 92 from the end position 4 into the removed position 6, the slider 95 has to be passed through. The first stop 57 on the latching recess 37 prevents the protective cap 2 from being removed from the end position 4 into the removed position 6 without a rotary movement taking place. The slider 95 is formed in a geometrically different manner than the slider 15. The slider 95 does not extend in a V-shaped manner in the second portion 22, but in an arcuate manner. This results in a different course of the actuation force.

Figure 20:
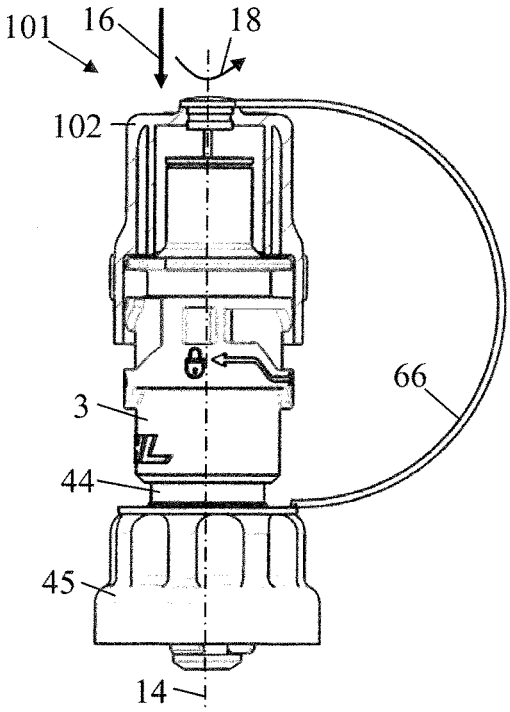
FIG. 20 is a schematic of a further variant embodiment of the tank filling system in partial section.
Figure 21:
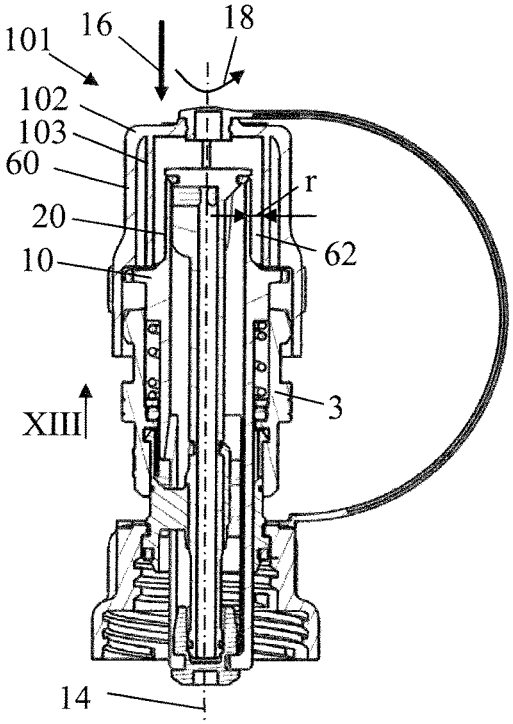
FIG. 21 shows a longitudinal section through the tank filling system from FIG. 20.
Figure 22:
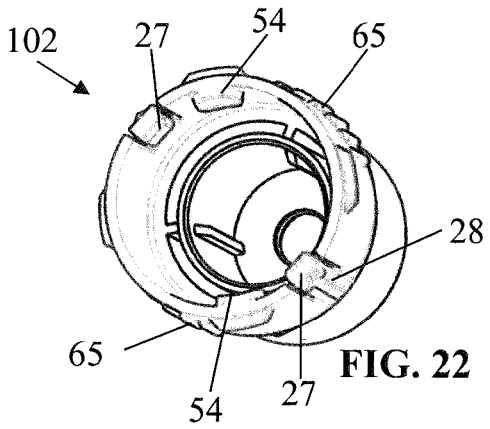
FIG. 22 is a perspective view of the protective cap from FIGS. 20 and 21.
Figure 23:
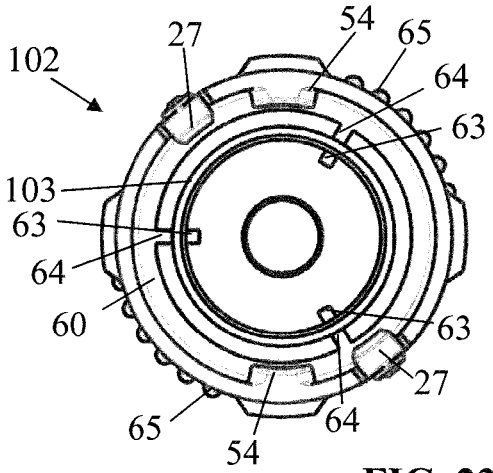
FIG. 23 shows a view of the protective cap in the direction of the arrow XXIII in FIG. 21.

FIGS. 20 to 23 show a further embodiment of a tank filling system 101. The tank filling system 101 has a protective cap 102, in which a clearance 62 between the protective cap 102 and the closure part 20 is reduced by an intermediate wall 103. As a result, fewer contaminants can accumulate in the protective cap 102. The intermediate wall 103 is arranged radially inside an outer wall 60 of the protective cap 102 and reduces the radial distance (r) between the inner side of the protective cap 102 and the valve 10 in the end position 4. In order to additionally reduce the clearance 62, protrusions 63, which are shown in FIGS. 22 and 23, are arranged on the inner side of the intermediate wall 103. Three protrusions 63, which are each arranged in a manner offset through 120° with respect to one another and are configured as ribs that extend parallel to the rotation axis 14, are arranged in the embodiment. The intermediate wall 103 is directly connected to the outer wall 60 via ribs 64. Three ribs 64 are provided in the embodiment. The intermediate wall 103 extends as far as the actuating element 19.

Formed on the outer side of the outer wall 60 of the protective cap 102 are gripping elements 65, for example gripping flutes, gripping recesses or the like. As FIGS. 20 and 21 show, the tank filling system 101 includes a connecting piece 66. The connecting piece 66 is fastened to the protective cap 102 at its first end and connected to the pouring spout 3 at its second end. The connecting piece 66 serves to captively connect the protective cap 2 to the pouring spout 3 even in the removed position 6.

Figure 24:
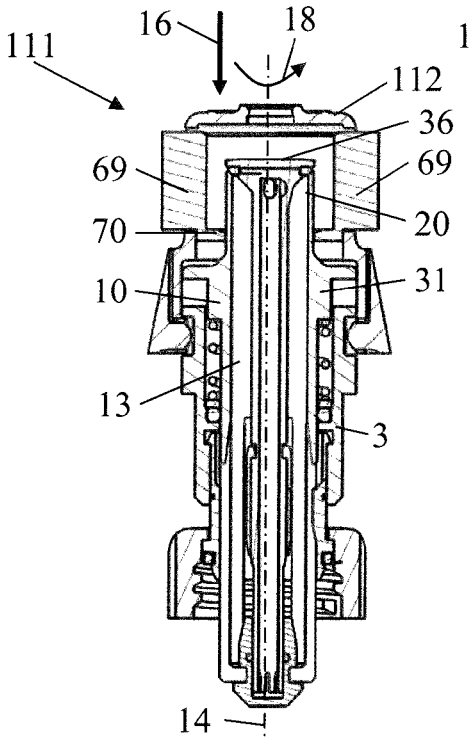
FIG. 24 shows a longitudinal section through a further variant embodiment of the tank filling system.
Figure 25:
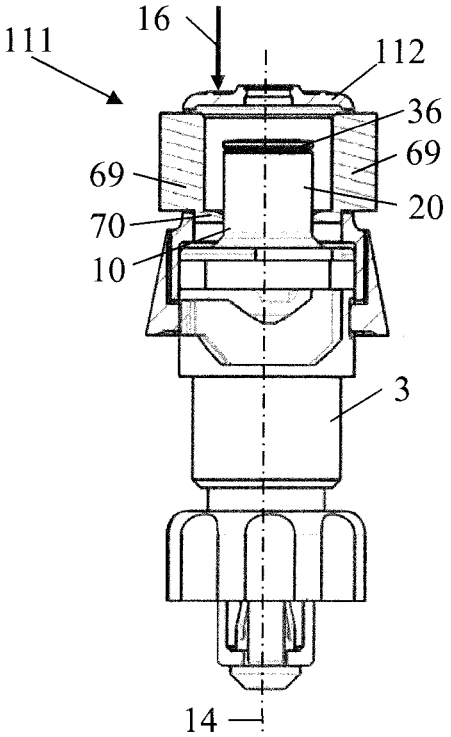
FIG. 25 is a schematic of the tank filling system from FIG. 24 in partial section; and, FIG. 26 is a perspective view of the protective cap of FIGS. 22 and 23.
Figure 26:
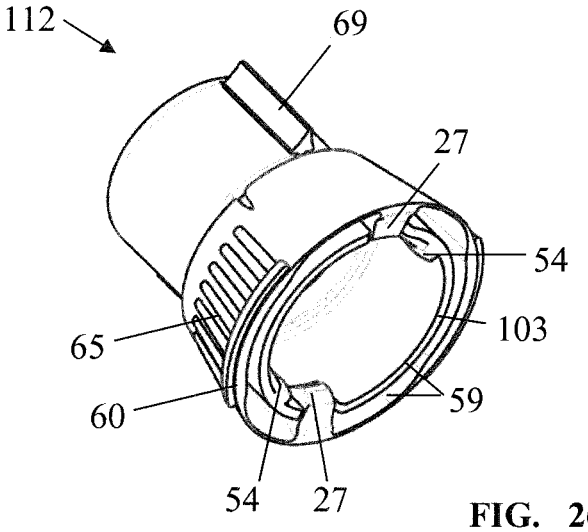

FIGS. 24 to 26 show a further embodiment of the tank filling system 111. The tank filling system 111 has a protective cap 112, which has two first scraping lips 69 and one second scraping lip 70. In the embodiment, the first scraping lips 69 and the second scraping lip 70 are configured in one piece. The first scraping lips 69 extend parallel to the rotation axis 14 on the outer side of the protective cap 112 and are oriented radially outward. The two first scraping lips 69 are arranged in a manner offset through 180° with respect to one another. Only one first scraping lip 69 can also be expedient. In the removed position 6 of the protective cap 2, an operator can remove dirt from the valve 10 by way of the first scraping lips 69.

The second scraping lip 70 is arranged within the protective cap 112 and oriented approximately perpendicularly to the rotation axis 14. When the protective cap 112 is placed onto the pouring spout 3, the second scraping lip 70 scrapes contaminants from the valve 10.

As FIG. 26 shows, the protective cap 112 has a continuous outer wall 60 on which the guide portions 27 are held. The guide portions 27 are not arranged on arms 28, as in the preceding embodiments. The outer wall 60 is formed in an elastic manner and deforms elastically when the protective cap 112 is put on and taken off, wherein the regions at which the guide portions 27 are arranged are deflected outward. The operator can push in a supporting manner on the gripping elements 65, which are arranged centrally in the circumferential regions located between two guide portions 27. If the gripping elements 65 are moved inward, the portions which carry the guide portions 27 deflect radially outward and it is possible to put on or take off the protective cap 112 with little effort. As FIG. 26 also shows, the protective cap 112 has an intermediate wall 103, and the guide elements 54 are provided on the intermediate wall 103. During the elastic deformation of the outer wall 60, no deformation of the intermediate wall 103 takes place, on account of the distance between the intermediate wall 103 and the outer wall 60. Since the guide elements 54 do not have a latching function, elastic deformation of the intermediate wall 103 is not necessary.

In all the embodiments, identical reference signs denote mutually corresponding elements. In the embodiments, the valve via which the liquid container 7 is forcibly vented during the removal of the protective cap (2, 92, 102, 112) is a valve 10 which, during the filling of a tank, ensures that the tank is vented during the filling operation. However, some other valve or an additional valve for forcibly venting the liquid container 7 during the removal of the protective cap (2, 92, 102, 112) can also be provided.

It is understood that the foregoing description is that of the preferred embodiments of the invention and that various changes and modifications may be made thereto without departing from the spirit and scope of the invention as defined in the appended claims.

What is claimed is:

1. A tank filling system comprising:

a pouring spout;

a removable protective cap;

said removable protective cap defining an end position and an opened position;

said removable protective cap being configured to at least partially cover said pouring spout in said end position;

said removable protective cap being configured to be removable from said pouring spout when in said opened position;

said pouring spout having a valve;

said valve having a venting position and a closed position;

a through passage;

said valve being configured to clear said through passage for passing a fluid in said venting position thereof and to close said through passage in said closed position;

said valve being further configured to be in said closed position thereof when said removable protective cap is in said end position and when said removable protective cap is in said opened position; and, said protective cap forcibly actuates said valve such that said valve is forcibly at least temporarily in said venting position when said removable protective cap is shifted from said end position to said opened position thereof.

2. The tank filling system of claim 1 further comprising:

an actuating element arranged on said removable protective cap;

said valve including a closure part; and, said actuating element being configured to, at least temporarily, actuate said closure part and change position of said valve when said removable protective cap is shifted from said end position into said opened position thereof.

3. The tank filling system of claim 2 further comprising:

a constraining guide acting between said removable protective cap and said pouring spout to compulsorily actuate said closure part; and, said constraining guide including a guide section and a slider.

4. The tank filling system of claim 3, wherein said closure part is resiliently mounted so as to cause a resulting resilient force to press said valve into said closed position thereof.

5. The tank filling system of claim 3, wherein:

said removable protective cap rotates around a rotational axis when being shifted from said end position to said opened position;

said constraining guide is configured to move in a direction of said rotational axis when said removable protective cap is rotated about said rotational axis; and, said actuating element is configured to at least temporarily actuate said closure part in the direction of said rotational axis.

6. The tank filling system of claim 3 further comprising:

an elastic arm fixed on said removable protective cap; and, said guide section being arranged on said elastic arm.

7. The tank filling system of claim 6, said removable protective cap being in a removed position when said removable cap is removed from said pouring spout; wherein said elastic arm elastically deforms at least once when said removable protective cap is moved from said removed position to said end position.

8. The tank filling system of claim 1 further comprising:

a latching device arranged on said pouring spout; and, said removable protective cap being configured to latchingly engage said latching device in said end position.

9. The tank filling system of claim 1, wherein:

said removable protective cap being in a removed position when said removable cap is removed from said pouring spout;

said removable protective cap is at least in part elastic; and, said removable protective cap is configured to be movable from said removed position to said end position through at least partial elastic deformation without forced venting.

10. The tank filling system of claim 1 further comprising:

a first stop arranged on said pouring spout; and, said first stop being configured to prevent a removal of said removable protective cap from said end position into the removed position without a rotational movement.

11. The tank filling system of claim 10 further comprising a second stop arranged on said pouring spout and configured to prevent a venting in said end position.

12. The tank filling system of claim 1, wherein:

said pouring spout has a fastening arrangement configured to fasten said pouring spout to a liquid container; and, said removable protective cap has a fastener configured to fix said removable protective cap to said fastening arrangement.

13. The tank filling system of claim 1 further comprising at least one wiping lip arranged on said removable protective cap.

14. A tank filling system comprising:

a pouring spout;

a removable protective cap;

said removable protective cap defining an end position and an opened position;

said removable protective cap being configured to at least partially cover said pouring spout in said end position;

said removable protective cap being configured to be removable from said pouring spout when in said opened position;

said pouring spout having a valve;

said valve having a venting position and a closed position;

a through passage;

said valve being configured to clear said through passage for passing a fluid in said venting position thereof and to close said through passage in said closed position;

said valve being further configured to be in said closed position thereof when said removable protective cap is in said end position and when said removable protective cap is in said opened position; and, said protective cap forcibly actuates said valve such that said valve is forcibly at least temporarily in said venting position when said removable protective cap is shifted from said end position to said opened position thereof so as to cause said valve to be compulsorily opened during a removal of said removable protective cap from said pouring spout initiated from said end position.

* * * * *